US007047788B2

(12) United States Patent
DeMichele et al.

(10) Patent No.: US 7,047,788 B2
(45) Date of Patent: May 23, 2006

(54) PRECISION CONTROL OF AIRFOIL THICKNESS IN HOT FORGING

(75) Inventors: Stephen Robert DeMichele, Pittsford, VT (US); Richard Lucien Couture, Castleton, VT (US); Sukhminder Singh Grewal, New Haven, CT (US)

(73) Assignee: General Electric Company, Schenectady, NY (US)

( * ) Notice: Subject to any disclaimer, the term of this patent is extended or adjusted under 35 U.S.C. 154(b) by 252 days.

(21) Appl. No.: 10/725,301

(22) Filed: Dec. 1, 2003

(65) Prior Publication Data

US 2005/0115297 A1 Jun. 2, 2005

(51) Int. Cl.
*B21D 53/78* (2006.01)
*B21C 51/00* (2006.01)

(52) U.S. Cl. ..... 72/364; 72/16.5; 72/3

(58) Field of Classification Search ..... 72/19.1, 72/16.5, 16.3, 20.5, 20.3, 20.1, 18.3, 31.01, 72/3

See application file for complete search history.

(56) References Cited

U.S. PATENT DOCUMENTS

| | | | | |
|---|---|---|---|---|
| 4,006,016 | A | 2/1977 | Zambrow et al. | |
| 4,154,075 | A | 5/1979 | Spiegelberg | |
| 4,479,833 | A | 10/1984 | Gessinger et al. | |
| 4,502,309 | A | 3/1985 | Hamilton et al. | |
| 4,771,818 | A | 9/1988 | Kenney | |
| 4,841,614 | A | 6/1989 | MacNitt et al. | |
| 5,055,752 | A | 10/1991 | Leistensnider et al. | |
| 5,063,662 | A | 11/1991 | Porter et al. | |
| 5,257,522 | A | 11/1993 | Miki et al. | |
| 5,263,531 | A | 11/1993 | Drury et al. | |
| 5,406,824 | A | 4/1995 | Toda et al. | |
| 5,507,164 | A | 4/1996 | Trausi et al. | |
| 6,138,491 | A * | 10/2000 | Grewal et al. | 72/420 |
| 6,223,573 | B1 * | 5/2001 | Grewal et al. | 72/19.1 |
| 6,230,539 | B1 | 5/2001 | Dickson et al. | |

FOREIGN PATENT DOCUMENTS

| | | | |
|---|---|---|---|
| JP | 8-229628 | | 9/1996 |
| JP | 8229628 | * | 9/1996 |

* cited by examiner

*Primary Examiner*—Derris H. Banks
*Assistant Examiner*—Debra Wolfe
(74) *Attorney, Agent, or Firm*—McNees Wallace & Nurick LLC

(57) ABSTRACT

A method for providing improved thickness control of a workpiece formed by impact forming. An impact forming device includes an upper die and a lower die that is configured and disposed for receiving the heated workpiece. The upper die is operatively connected to a ram for directing the upper die into a controlled impact with the lower die while the workpiece is positioned between the upper die and the lower die. This controlled impact forms the workpiece. A precise relationship is determined between a finished thickness of the workpiece and a time duration that the workpiece is in contact with the lower die prior to impact with the upper die to achieve the particular workpiece thickness. Once the workpiece is placed on the lower die, the ram is actuated to effect the controlled impact of the upper and the lower die in response to the precise relationship.

10 Claims, 7 Drawing Sheets

PRECISION CONTROL OF AIRFOIL THICKNESS IN HOT FORGING

BACKGROUND OF THE INVENTION

The present invention relates to the hot forming or forging of metal workpieces and, more particularly, to an improved method of precisely controlling the finished thickness of the forged metal workpieces. The term metal, as used herein, includes both elemental metals and alloys unless indicated otherwise.

Numerous methods for the solid state forming of metallic workpieces or blanks into selected shapes include forging and rolling. Press forging and trimming are two widely used techniques in which the metal is worked at an elevated temperature such as for the formation of gas turbine engine blade airfoils. In a typical forging operation, an unformed workpiece is pre-heated to forging temperature and then shaped with a hammer or ram of a forge press. The unformed workpiece is typically a pre-form having an approximate shape to that of the formed workpiece. In a typical trimming operation, the formed workpiece is trimmed while still hot from the forging process and excess metal and/or flash formed during the forging process is trimmed using trimming dies and a hammer or ram of a trim press. The unformed workpiece is typically a pre-form having an approximate shape to that of the formed workpiece.

The hot forming or forging process requires a heated workpiece at a high temperature, typically above 1,700° F. The forge dies, though often heated, are at a much lower temperature, typically less than 500° F. or even at room temperature. The large temperature differential and the high thermal diffusivity of the metals being forged causes a rapid heat transfer. The temperature of the workpiece in contact with the die drops in temperature at a rate of 100° F. per second or more. The thinner the workpiece the larger the relative effect of this temperature drop. In the absence of any other reheating methods, the temperature of the workpiece falls in a transient way until the ram of forge press impacts the upper die against the workpiece. Afterwards, the workpiece temperature continues to fall until the workpiece is removed from contact with the metal die or until it reaches the same temperature as the die. The trimming process is similar in that the formed workpiece is at a substantially higher temperature than the trim dies.

The physical properties of the workpiece material at time of impact of the forge press on the workpiece are primarily a function of the temperature at time of impact. These physical properties contribute to the results of the forging process in terms of extent of deformation achieved with a specific forge force as well as the flow of material caused by the forge forces. In addition there is heat generated in the material during deformation caused by the plastic deformation which also affects the results of the forging process. A similar situation exists for the trimming process as regards the deformation in terms of change in shape of the workpiece. This deformation is relatively minor compared to that during forging. On the other hand, the trim size itself and the orientation of features of the workpiece relative to each other can be significantly affected.

The conditions of the workpiece at the exact instant of impact by the ram are determined by the transient temperature distribution through the workpiece which, in turn, is determined by the heat transfer from the workpiece to the die. The heat transfer primarily depends on two parameters: (1) the heat transfer coefficient or resistance to the heat transfer from the workpiece to the die and (2) the time of contact with the colder die during which the heat transfer takes place.

Variations in these two parameters during the forging and trimming processes affect repeatability of the processes and hence the consistency of the parts that are forged and trimmed. It is very desirable to have a high degree of repeatability in forging and trimming processes and forged and trimmed parts that are more consistent.

U.S. Pat. No. 6,223,573 B1, issued to applicants, is directed to methods and apparatus for operating a press that includes an upper die that controllably impacts a lower die to shape a workpiece that is placed on the lower die. The upper die is controllably monitored either to impact the lower die after a workpiece contacts the lower die for a predetermined fixed period of time, or to impact the lower die some predetermined fixed period of time after sensing a predetermined fixed temperature of a predetermined location of the workpieces. This controlled monitoring produces improved repeatability of workpiece. However, by providing fixed periods of time for each controllably monitored process, the precision of parts produced is improved, but limited. This limitation does not employ a precise relationship between a finished thickness of a workpiece, the temperature of the workpiece, and the period of time the workpiece is in contact with the lower die period to impact with the upper die. With this precise relationship, which does not use fixed time periods to account for changing conditions, workpieces produced by the present invention, which is discussed in further detail below, achieves significant precision improvement that makes workpiece thickness control up to about 0.0015 inches possible.

The variation in the heat transfer coefficient and the time of contact causes substantial variations between parts in the temperature profile in the workpiece and thereby causes variation in the shape, form and thickness of the product. This variation is significant because of the precision required in gas turbine engines and, in particular, aircraft gas turbine engine airfoils. In the case of airfoils, which are of thin construction, typically tapering to approximately 0.050 inches at the edge of the airfoil, the rate of temperature drop upon contact with the lower die is significantly larger than the rest of the part. As such, the flow stress in the airfoil increases rapidly as the temperature of the airfoil decreases. As used herein, the term "thin parts" refers to parts having a significant amount of edge thickness of about 0.10 inches or less, which edge thickness being critical to the successful operation of the part. It has been found that for thin parts, thickness control has been difficult to achieve more precisely than about 0.008 inches. That is, a range from about 0.004 inches above a nominal thickness of the part to about 0.004 inches below the nominal thickness of the part. In addition to the range of part thickness, there is also a range associated with the orientation of the airfoil, or in other words, the twist of the airfoil.

Various corrective actions are currently used in forge shops to reduce these variations. Adjustments of other press and forming parameters, benching and changing the shape of the dies, subsequent cold working and hot working, chemical metal removal are all used to reduce part-to-part variation to meet tolerance requirements. These corrective operations increase the cost of production and inventory, due to the number of additional tools required, and also increase the cycle time for making the part.

Any variation in the temperature of the workpiece at the instant of impact during operation of trim and forge presses affects the stress and deformation of the workpiece which then causes a variation in the orientation and thickness of portions of the part. In the case of an airfoil of a gas turbine engine blade, in addition to the variation in the shape and thickness of the part, workpiece temperature variation also causes variations in the orientation of the airfoil with respect to the dovetail and platform. In the trim process it also causes variations in the chord length of the airfoil. These variations cause difficulty in meeting the tolerance requirements of the component. Subsequent operations to manually bench or deform the part to conform to the orientation required and to grind the chord length add significant cost to the part in time required to produce the part and in the additional holding fixtures and tools required by these additional operations. For the high degree of precision required in aviation airfoils, this variation result in substantial cost increases. Parts that deviate to a further extent from the nominal dimensions and/or profiles require still further adjustments or other press and forming parameters, or are scrapped.

Another factor that affects repeatability or part-to-part variation is the additional variability due to operators working at different speeds and variations during the shift of the same operator. These differences cause both the time of contact and the heat transfer coefficient to vary with consequent variation in the part geometry. There is a need to reduce part-to-part variation in the forging and trimming processes using presses and improve consistency of hot formed parts made with forge and trim presses.

SUMMARY OF THE INVENTION

The invention is related to a method for providing improved thickness control of a workpiece formed by impact forming. An impact forming device includes an upper die and a lower die, the lower die being configured and disposed for receiving the workpiece thereon, the workpiece being heated to a predetermined first temperature that is above the upper die temperature, the lower die temperature, and the impact temperature of the workpiece. The upper die is operatively connected to a ram for directing the upper die into a controlled impact with the lower die with the heated workpiece interposed therebetween to effect the impact forming of the workpiece. The steps include determining a precise relationship between a finished thickness of the workpiece, the temperature of the workpiece and a period of time that the workpiece is in contact with the lower die prior to impact with the upper die to achieve the particular workpiece thickness; placing the workpiece on the lower die; actuating the ram to effect the controlled impact of the upper and the lower die in response to the precise relationship. This relationship is extremely important for workpieces that have thin cross-sections, such as those found in airfoils.

Among the main advantages of the present invention is to make forging and trimming processes more repeatable by improved thickness control of the parts so that the parts that are forged and trimmed are more consistent. The invention reduces variation in the shape and form and thickness of parts and is particularly significant to meet the precision required in the production of aviation airfoils. By improved thickness control, various corrective actions that are currently used in forge shops to reduce part-to-part variation to meet tolerance requirements are reduced and/or eliminated. These actions include; adjustments of other press and forming parameters, benching and changing the shape of the dies, subsequent cold working and hot working, and chemical metal removal. These subsequent corrective operations increase the cost of production and inventory and also increase the cycle time for making the part. Still another advantage of the present invention is that the scrap rate of airfoil forgings can be reduced.

The present invention reduces part-to-part variation due because of additional variability due to operators working at different speeds and variation during the shift of same operator.

With respect to trimming operations, the invention reduces variation in the trim region dimensions and in the orientation of portions of the part. In the case of an airfoil of a gas turbine engine blade it reduces variations in the orientation of the airfoil with respect to the dovetail and platform and in the chord length of the airfoil.

BRIEF DESCRIPTION OF THE DRAWINGS

Whenever possible, the same reference numbers will be used throughout the drawings to refer to the same or like parts.

DETAILED DESCRIPTION OF THE INVENTION

Figure 1:
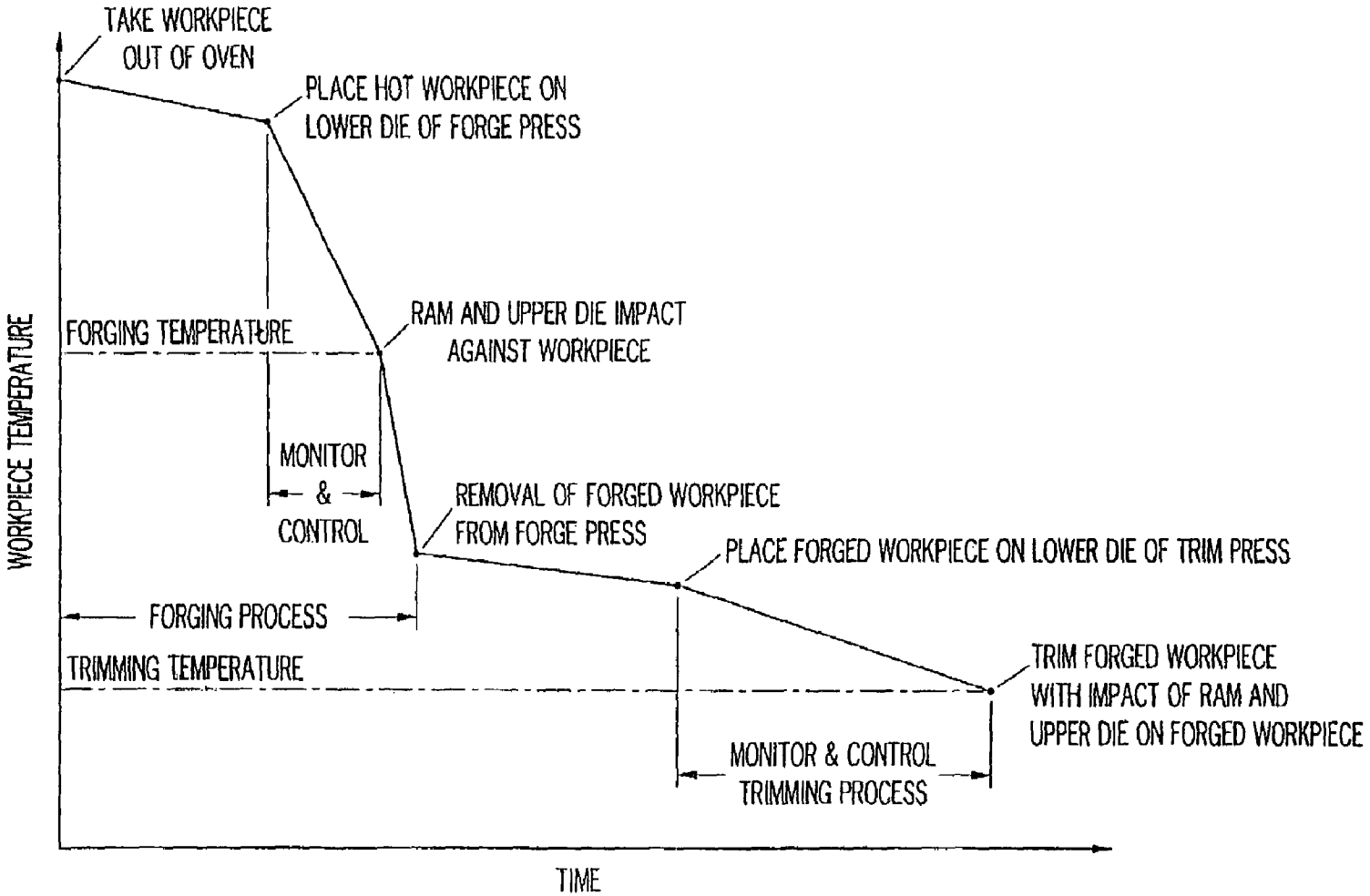
FIG. 1 is a graphical illustration of a method for forming and trimming a workpiece using an exemplary embodiment of the present invention.
Figure 2:
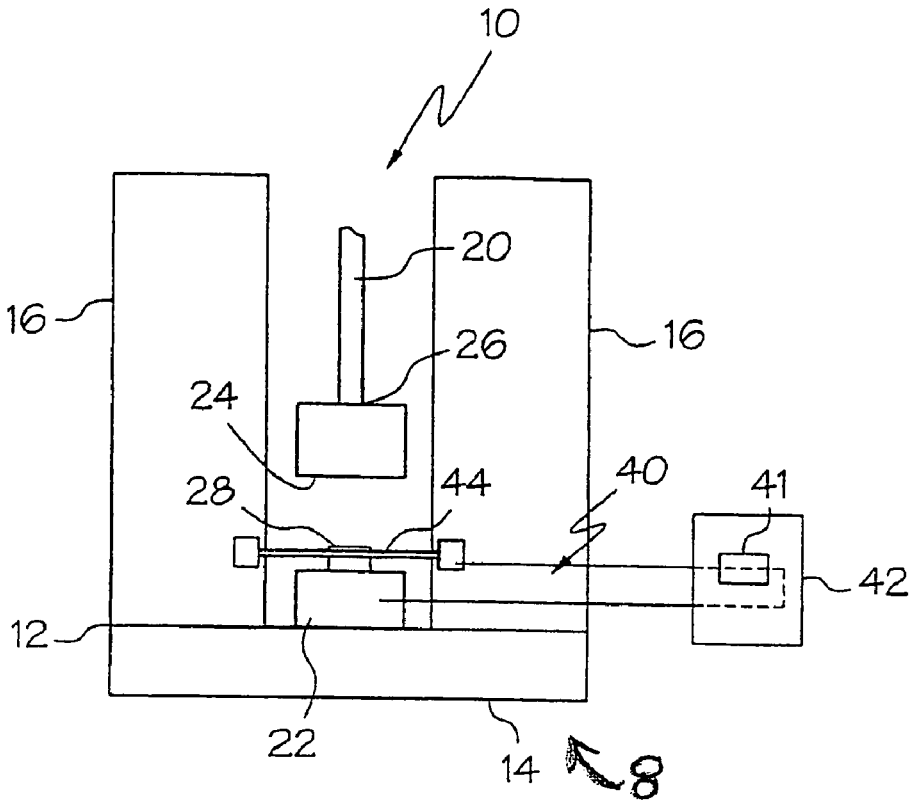
FIG. 2 is a front view schematical illustration of an exemplary embodiment of a forge press apparatus of the present invention.

The invention includes methods as graphically illustrated in FIG. 1 for operating a typical press apparatus 8 such as a forge press 10 schematically illustrated in FIG. 2. The press 10 has a frame 12 with a base 14 on the bottom of the frame 12 and columns 16 extending upward that support a ram 20 operable to quickly move linearly in a downwardly direction with a great deal of force. A lower die 22 rests fixedly supported on the base 14 and an upper die 24 is mounted on a bottom portion 26 of the ram 20. A hot pre-formed or unformed workpiece 28, such as an airfoil blank, placed on the lower die 22 is impacted by the upper die 24 when the ram 20 is actuated.

Figure 4:
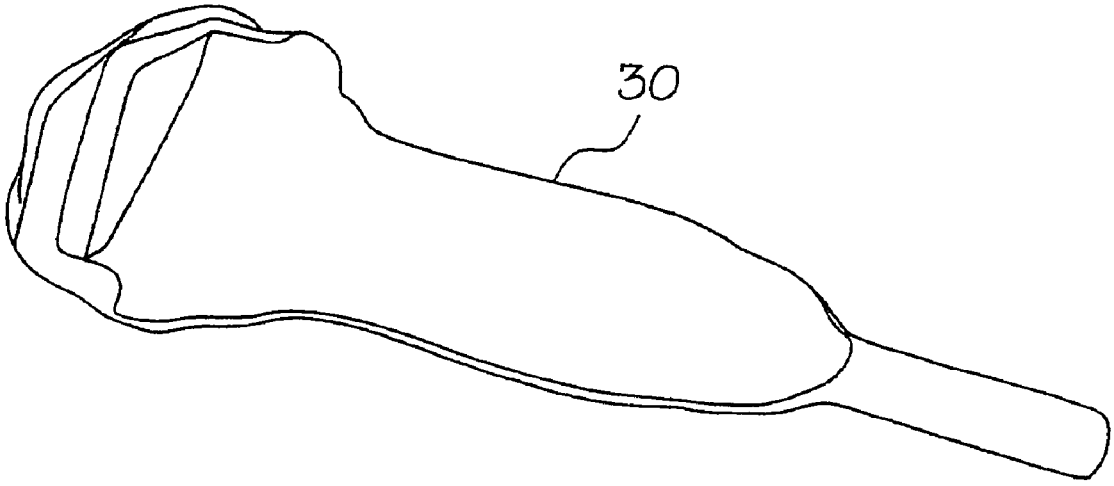
FIG. 4 is a perspective view of gas turbine engine blade forge pre-form exemplifying a workpiece used in the present invention as illustrated in FIG. 1.
Figure 5:
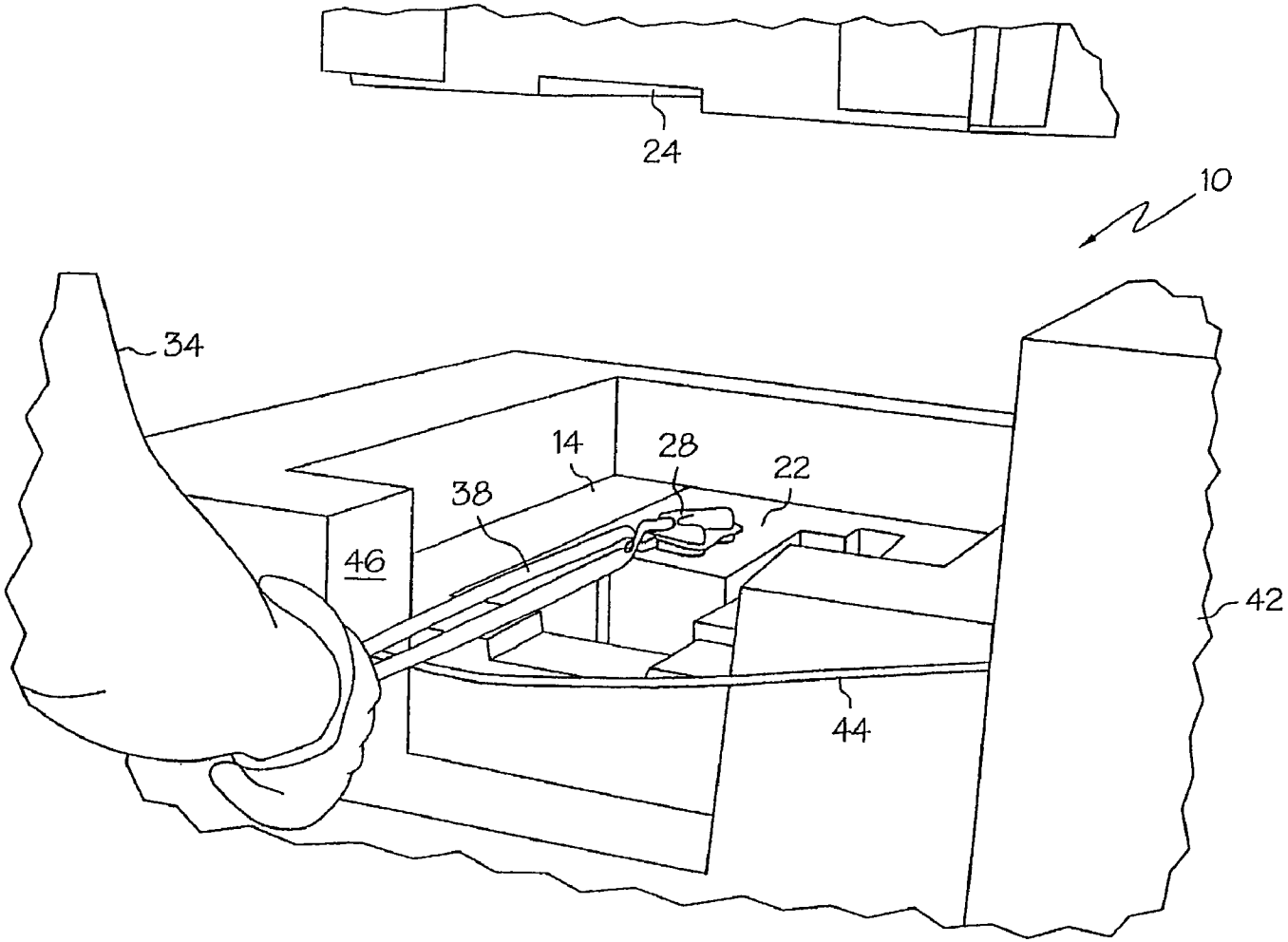
FIG. 5 is a perspective schematical illustration of a forge press including a wire for an electrical starting circuit of the press apparatus in FIG. 1.

Referring to FIGS. 1 and 2, the unformed workpiece 28 is heated in an oven (not shown) to a first temperature above a forging temperature and then shaped using the ram 20, of the forge press 10 to impact the upper die 24 on the workpiece 28. The unformed workpiece 28 is illustrated in FIG. 4 as a pre-form 30 of a gas turbine engine blade having an approximate shape to that of the formed workpiece. FIG. 5 illustrates the hot pre-formed workpiece 28, which has been manually removed from the oven by an operator 34 using a tool such as tongs 38 to hold the workpiece 28, being disposed in the lower die 22. Using the tongs 38, the operator manually places the workpiece 28 on the lower die 22 of the forge press 10. Though the lower die 22 may be pre-heated, it is well below the temperature of the hot workpiece 28 and the forging temperature. In one exemplary forging operation, the forging temperature is about 1700° F. and the lower die is pre-heated to about 500° F.

The temperature of the unformed workpiece in contact with the lower die drops at a rate of about 100° F. per second or more during a time period referred to as chill down as illustrated in FIG. 1. The relative effect of chill on the quality of the forging process is larger for thinner workpieces. In the absence of any other reheating methods, the temperature of the workpiece continues to decrease in a transient way until the upper die 24 of the forge press 10 impacts the workpiece 28 at the end of chill down. After impact of the upper die 24 against the workpiece 28, the temperature of the workpiece 28 continues to decrease, until the workpiece is removed from contact with the metallic lower die 22 or until it reaches the same temperature as the lower die. The present invention monitors the duration of time the unformed workpiece 28 is placed in the lower die 22 and controls actuation of the ram 20 to which is attached the upper die 24 based on a predetermined relationship between the workpiece thickness and the time the workpiece is placed in the lower die 22.

Figure 8:
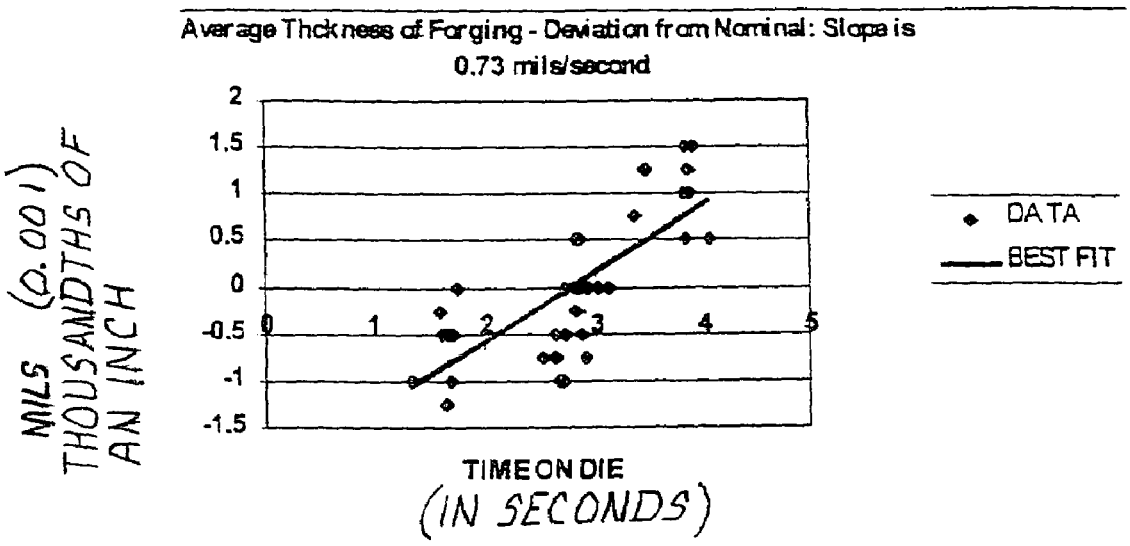
FIG. 8 is a graph illustrating a relationship between part thickness deviation from a nominal thickness versus the duration of time the part is on the lower die prior to contact with the upper die.

Referring to FIG. 8, this relationship is based on test results which plot workpiece thickness deviation from a nominal part thickness in the vertical axis, measured in mils (thousandths of an inch). In other words, "one" on the vertical axis corresponds to a part thickness that is one thousandth of an inch (1 mil) thicker than the nominal part thickness, and any negative number corresponds to a part thickness that measures less than the nominal part thickness. The horizontal axis represents the duration of time, in seconds, that a workpiece is placed on the lower die prior to impact with the upper die. The line drawn through the data is a best fit based on a linear regression analysis, wherein the slope of the line corresponds to 0.73 thousandths of an inch (0.00073), or mils, per second. By inspection of the data, it appears that for at least the configuration of the workpiece being tested, which is an aircraft compressor blade or vane, the workpiece should remain in the lower die for no longer than about three seconds. One having skill in the art realizes that this relationship, which is depicted as linear, may not be linear, but may define the curve that best corresponds with the data to achieve an optimum amount of precision workpiece thickness control.

Similar relationships will undoubtedly exist for other thin parts. As used herein, the term "thin parts" refers to workpieces having a significant amount of edge thickness of about 0.10 inches (100 mils) or less, preferably about 0.050 inches (50 mils), the edge thickness being critical to the successful operation of the part. Due to the thinness of such workpieces, the decrease in workpiece temperature causes a rapid increase in impact forces required to decrease the thickness of the workpiece. Stated another way, the flow stresses of the thin parts, which resist the effects of the impact between the dies, increases rapidly as the part temperature decreases. Without intending to be bound by theory, it is believed that for these thin parts, due to the magnitude of the increased strain rate characteristics, the forge dies themselves elastically deform, which may now be further taken into account when determining the relationship between part thickness and lower die time contact prior to impact with the upper die.

Once a precise relationship between the workpiece thickness, which is preferably the finished workpiece thickness, the temperature of the workpiece, and the time duration the workpiece is in the lower die is established, workpiece thicknesses can be much more tightly controlled. Using the relationship of the present invention, the four thousandths of an inch tolerance on either the plus or minus side of a nominal thickness, +/−0.004 inches, can be dramatically improved to about fifteen ten thousandths (1.5 mils) on the plus or minus side of the nominal thickness +/−0.0015 inches. Not only is this a significant improvement in parts thickness, but also in the orientation of the part, i.e., the twist of the airfoil. Such improvements in precision fabrication will require fewer, less involved subsequent machining steps, and may eliminate the need for a number of the tools formerly required to produce these parts.

It is realized that this relationship is based on certain conditions, such as workpiece temperature, die temperature, of or workpiece thickness, and that any deviation from these conditions will likely affect the relationship. It is contemplated that the method of the present invention may be modified, such as by adding or subtracting a fraction of a second of time the workpiece is in the lower die prior to contact of the lower die with the upper die, to achieve the desired part thickness control. This modification can be in the form of a manual adjustment, or an automated adjustment, such as through the use a of sensing equipment that compensate for changes in workpiece temperature, die temperature, or workpiece thickness and may be incorporated in combination with any of the various embodiments descibed below.

The present invention actuates the ram 20 in a controlled manner based upon monitoring of the unformed workpiece on the lower die 22 to effect an impact of the upper die 24 against the workpiece 28. The workpiece 28 is, in the exemplary embodiment, the preform 30 for an airfoil, such as a blade or vane of a gas turbine engine and the forging process forms the airfoil portion of the blade. After forging, the formed workpiece 28 is removed from the forge press 10 and while still hot, is placed onto the lower die 22 of a trim press not separately illustrated, but which in operation and schematically resembles that of the forge press 10. The ram 20 of the trim press is also actuated in a controlled manner based upon the monitoring of the now formed workpiece 28 on the lower die 22 of the trim press to effect an impact of the upper die 24 of the trim press against the formed workpiece 28 to trim off excess material, such as flash, from the airfoil of the formed workpiece. The trim dies are generally at room temperature.

Figure 3:
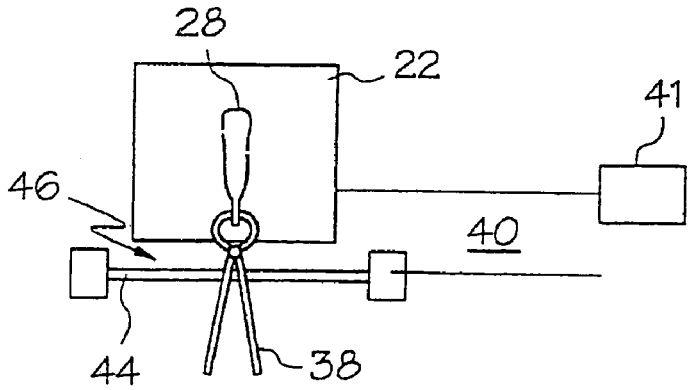
FIG. 3 is a top view schematical illustration of part of the press apparatus in FIG. 2.

In one embodiment of the present invention, the monitoring includes measuring a characteristic parameter of the workpiece and the actuating includes actuating the ram 20 after a substantially predetermined value of the measured parameter is measured. FIGS. 2, 3, and 5 illustrate the characteristic parameter being a contact time period of the workpiece 28 with the lower die 22 and the measuring includes starting to measure the contact time period of the workpiece with the lower die as soon as contact is made between the workpiece and the lower die. The ram 20 is actuated to have the impact to occur at a substantially predetermined period of time after the contact is made. An electrical starting circuit 40 includes a timer 41 in a preferably digital electronic controller 42 which controls the press 10 and actuates the ram 20. The operator 34 manually places the workpiece 28 or pre-form 30 on the lower die 22 with the tongs 38. The electrical starting circuit 40 includes a wire 44 stretched across the front 46 of the press 10 and the lower die 22. The operator 34 completes the electrical starting circuit 40 by having the tongs 38 make and stay in contact with the wire 44 near the lower die 22 as the workpiece is placed onto the lower die. The timer 41 in the controller 42 is initiated to start measuring the contact time period after completing the electrical starting circuit 40 in series from the wire 44 through the tongs 38, the workpiece 28, and the lower die 22. The timer 41 may be set to start when contact is made and the electrical circuit 40 is completed or after the circuit is broken, preferably when the operator removes the tongs 38 from contact with the workpiece 28 while the tongs are still in contact with the wire 44. While the contact time period is substantially predetermined, it is not a fixed time period, as this time period is periodically monitored to satisfy the precise relationship previously discussed which is necessary to achieve the desired precision of workpiece dimensions and profile.

Figure 6:
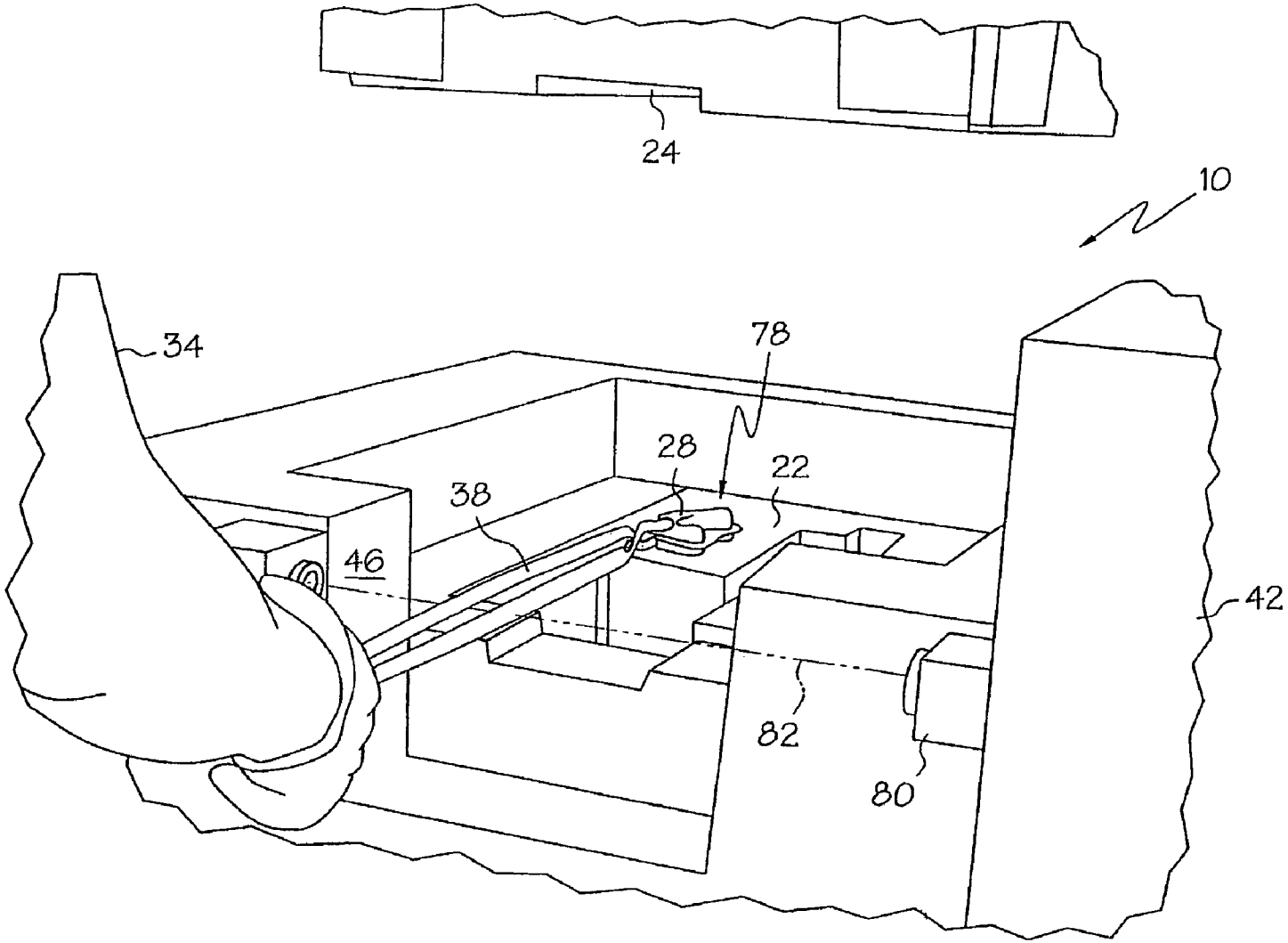
FIG. 6 is a perspective schematical illustration of a first alternative embodiment of a forge press apparatus of the present invention having an electric eye used to start a timer.

Illustrated in FIG. 6 is another embodiment of the invention uses a location of the workpiece 28 on the lower die 22 as the characteristic parameter and the measuring includes detecting whether the workpiece is at a predetermined and fixed location 78 on the lower die, and actuating includes actuating the ram to effect the impact after the workpiece is at the predetermined and fixed location on the lower die. An electric eye 80 with a light curtain 82 is used in a more particular embodiment to detect when the workpiece 28 is at the predetermined and fixed location 78 on the lower die and start the timer 41 that actuates the ram to effect the impact at a substantially predetermined period of time after the timer starts. Preferably, the embodiment includes breaking a light curtain of the electric eye during the placing of the workpiece on the lower die to start the monitoring, and the timer 41 is started by re-establishing the light curtain after placing the unformed workpiece on a lower die. While the time period is substantially predetermined, it is not a fixed time period, as this time period is periodically monitored to satisfy the precise relationship previously discussed which is necessary to achieve the desired precision of workpiece dimensions and profile.

Figure 7:
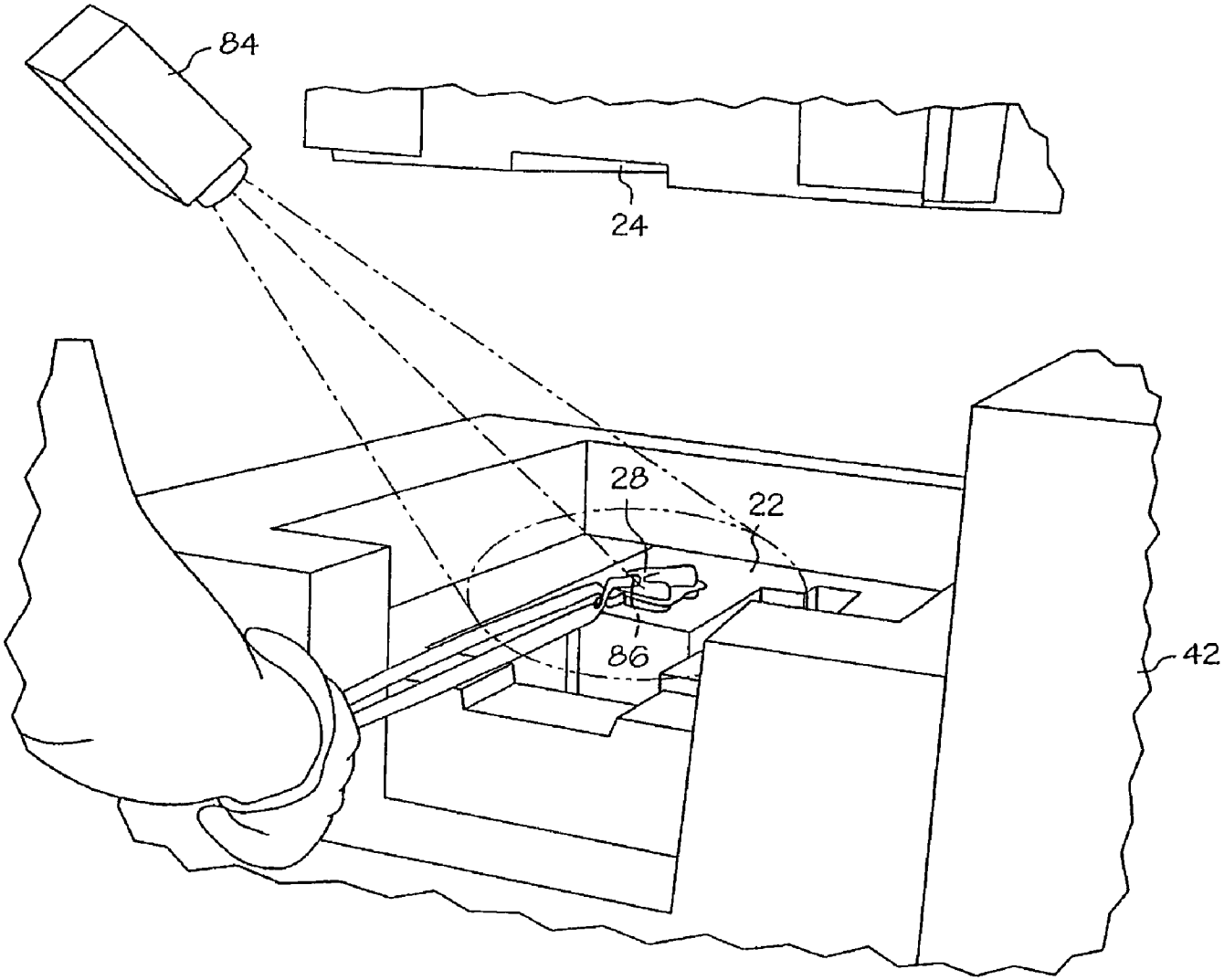
FIG. 7 is a perspective schematical illustration of a second alternative embodiment of a forge press apparatus of the present invention having an infrared camera used to start a timer.

Illustrated in FIG. 7 is yet another embodiment of the present invention in which the characteristic parameter is an actual transient temperature and the measuring comprises measuring the transient temperature with an infrared detector 84 aimed at a predetermined and fixed position 86 on the workpiece 28. The ram 20 is actuated to have the impact to occur at a substantially predetermined period of time after a predetermined fixed temperature is sensed by the infrared detector 84, to satisfy the precise relationship previously discussed.

The press 10 may also be a trim press to trim the formed workpiece or part to remove excess material such as flash attached to the workpiece after it has been formed in the forge press or other type of press incorporating the features of the present invention. The press with the infrared detector 84 is particularly suitable for trimming. The IR detector 84 is placed with a direct view of the workpiece 28 as it would be placed on the lower die 22. A "dummy workpiece" with a circle or other mark inscribed on it or a hole drilled in it marks the focal point of a lens of the IR detector 84. The IR detector 84 is aligned to this target mark. The IR detector 84 includes a trigger device which closes a circuit at the point the temperature measured by the detector falls below the substantially predetermined temperature. The closing of the circuit actuates the ram 20 which operates to remove the flash by impacting the upper dies against the workpiece 28. Safety devices typically built into the controller 42 are not overridden. The controller requires the clearing of safety interrupts before the ram 20 is actuated. The substantially predetermined temperature is also preferably obtained by satisfying the precise relationship previously discussed with a typical goal to ensure that at least a 99% probability of repeatability of part tolerances such as orientation of portions of the part. In the case of an airfoil of a gas turbine engine blade this means at least a 99% probability of no variations in tolerances in the orientation of the airfoil with respect to the dovetail and platform and in the chord length of the airfoil. An indicator light is preferably included to alert the operator when the part was trimmed at a temperature lower than the predetermined fixed temperature because of an inadvertent delay or other reason.

The invention further optionally includes, in addition to the safety features, a lock-out capability to prevent the operator from actuating the ram 20 if the ram 20 cannot be actuated at the instant in time required to satisfy the precise relationship. In other words, if the precise relationship requires the ram 20 to be actuated at a particular instant, and, in fact, the ram 20 is not actuated at that instant, the lock-out feature is enabled. This feature prevents the workpiece from being struck if the conditions do not satisfy the precise relationship, thereby reducing the number of nonconforming workpieces produced.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for providing improved thickness control of a workpiece formed by impact forming, an impact forming device including an upper die and a lower die, the lower die being configured and disposed for receiving the workpiece thereon, the workpiece being heated to a predetermined first temperature that is above the upper die temperature, the lower die temperature, and the impact temperature of the workpiece, the upper die operatively connected to a ram for directing the upper die into a controlled impact with the lower die with the heated workpiece interposed therebetween to effect the impact forming of the workpiece, the steps comprising:

determining a precise relationship between a finished thickness of the workpiece, the temperature of the workpiece and period of time that the workpiece is in contact with the lower die prior to impact with the upper die to achieve the particular workpiece thickness;

placing the workpiece on the lower die;

actuating the ram within the period of time to effect the controlled impact of the upper and the lower die in response to the precise relationship (within the period of time).

2. The method of claim 1 wherein the thickness of the workpiece is within about 0.0015 inches from a nominal thickness.

3. The method of claim 1 wherein the precise relationship further includes the effects of die deformation.

4. The method of claim 1 wherein the precise relationship can be modified to achieve the desired thickness control.

5. The method of claim 4 wherein the precise relationship can be modified manually.

6. The method of claim 4 wherein the precise relationship can be modified automatically.

7. The method of claim 1 wherein the workpiece is a thin part.

8. The method of claim 7 wherein the thin part has a significant amount of edge thickness of about 0.10 inches or less, the edge thickness being critical to the successful operation of the part.

9. The method of claim 8 wherein the thin part has an edge thickness of about 0.050 inches.

10. The method of claim 1, wherein the step of actuating the ram is prevented when the precise relationship cannot be satisfied.

* * * * *

UNITED STATES PATENT AND TRADEMARK OFFICE

CERTIFICATE OF CORRECTION

PATENT NO. : 7,047,788 B2
APPLICATION NO. : 10/725301
DATED : May 23, 2006
INVENTOR(S) : Stephen Robert DeMichele et al.

It is certified that error appears in the above-identified patent and that said Letters Patent is hereby corrected as shown below:

Column 6, line 22, "of or workpiece" should be - - or workpiece - -.

Column 6, line 30, "use a of" should be - - use of - - .

Column 10, line 7, "claim 1, wherein" should be - - claim 1 wherein - -.

Signed and Sealed this

Twenty-second Day of August, 2006

JON W. DUDAS
*Director of the United States Patent and Trademark Office*